US007410399B2

(12) United States Patent
Blumenfeld

(10) Patent No.: US 7,410,399 B2
(45) Date of Patent: Aug. 12, 2008

(54) BODY BOARD FOR RECREATIONAL USE

(76) Inventor: Bruce Blumenfeld, 35 Belgrade Ter., West Orange, NJ (US) 07052

( * ) Notice: Subject to any disclaimer, the term of this patent is extended or adjusted under 35 U.S.C. 154(b) by 21 days.

(21) Appl. No.: 11/452,689

(22) Filed: Jun. 14, 2006

(65) Prior Publication Data

US 2006/0281377 A1 Dec. 14, 2006

Related U.S. Application Data

(60) Provisional application No. 60/690,618, filed on Jun. 14, 2005.

(51) Int. Cl.
*B63B 35/73* (2006.01)

(52) U.S. Cl. ..... 441/65

(58) Field of Classification Search ..... D21/769, D21/770; 114/288, 290; 441/74, 79, 65
See application file for complete search history.

(56) References Cited

U.S. PATENT DOCUMENTS 4,767,370 A * 8/1988 Campbell ..... 441/74
D305,349 S * 1/1990 Shanelec ..... D21/769
D317,343 S * 6/1991 Concannon ..... D21/769
5,273,470 A * 12/1993 Sneddon et al. ..... 441/65
5,797,779 A * 8/1998 Stewart ..... 441/74
D463,003 S * 9/2002 Alexander ..... D21/769

* cited by examiner

*Primary Examiner*—Ed Swinehart
(74) *Attorney, Agent, or Firm*—Weitzman Law Offices, LLC

(57) ABSTRACT

Disclosed herein is a shaped panel of material that is buoyant in water having a top with a width, a bottom with a total width, a front, a rear, and two sides, wherein the bottom of the shaped panel contains a shallow groove, the groove being spaced equidistant from the sides of the panel. The groove has a bottom with a width, 2 sides, and a depth. The bottom of the groove is flat and the width of the groove comprises at least ⅓ of the total width of the bottom of the body board. The width of the bottom is smaller than the width of the top and the width of the groove at the front and rear of the bottom are equal. The width of the groove at a point equidistant from the front and the rear of the bottom is smaller that said width at the front and rear of the bottom.

17 Claims, 4 Drawing Sheets

BODY BOARD FOR RECREATIONAL USE

This application claims priority to Provisional Application 60/690,618, Body Board for Recreational Use, filed Jun. 14, 2005.

FIELD OF THE INVENTION

The present invention relates generally to a body board or and more specifically to a buoyant board made of plastic used for recreational purposes.

BACKGROUND OF THE INVENTION

The sport of surfboarding has been popular for many years. As is well known in the art, the surfboard has evolved from a large, ponderous plank composed mainly of wood into today's modern version, consisting of sleek designs meticulously dimensioned to support the rider while providing the ultimate in handling and control, and constructed from modern polymers and other new materials.

Consistent with the development of the surfboard has been the development of the sport and related equipment for the body board. The body board, as is well known in the art, is a shorter version of the surfboard, designed to support a rider who is lying on the board in a prone position, rather than standing upright. The body board is significantly easier to use than a surfboard, and, as such, is much more popular. Practically anyone can use a body board to "ride the waves", whether young or old, professional or first-time recreational user.

OBJECT OF THE INVENTION

The body boards in regular use today have two distinct problems. First, in rough surf, children have a difficult time holding on to the board. Second, inexperienced riders have difficulty maneuvering the board while riding a wave. Therefore, it is one object of the present invention to provide a body board that children can use in rough surf. It is a second object of the present invention to provide a body board that inexperienced riders can easily ride and maneuver to obtain a longer ride and a more satisfying wave riding experience.

BRIEF SUMMARY OF THE PRESENT INVENTION

In a preferred embodiment of the present invention, a body board for recreational use for riding ocean waves is presented, wherein the body board is constructed of non-toxic polymer materials. The method of construction is a molding process that is well known in the art. The top of the board is contoured so that a person can comfortable place the upper torso portion of their body on the board with their legs handing over the back edge of the board. This preferred embodiment also comprises a channel shaped into the bottom of the board, such that, as the board is being ridden, water is directed through the channel. The channel is shaped to allow inexperienced riders to obtain more maneuverability and thus, longer and more enjoyable wave riding.

In another embodiment of the present invention, the channel is wider towards the front and back of the board than in the middle of the board.

In another embodiment of the present invention, a body board for recreational use is presented which comprises all the features of the preferred embodiment, and further comprises a raised ridge along the front and side edges of the board to allow a rider to grasp the board.

In yet another embodiment of the present invention, a body board for recreational use is presented which comprises all the features of the preferred embodiment, and further comprises a raised ridge running along the front and side edges of the body board, wherein an area defined on one edge by the raised ridge forms a depression in the top surface of the body board.

In yet another embodiment of the present invention, the bottom of the board comprises more than one channel. Each channel extends from the front to the back of the board. Each is configured such that each channel has a width that is wider towards the front and the back of the board than in the center of the board.

DETAILED DESCRIPTION OF THE DRAWINGS

Figure 1:
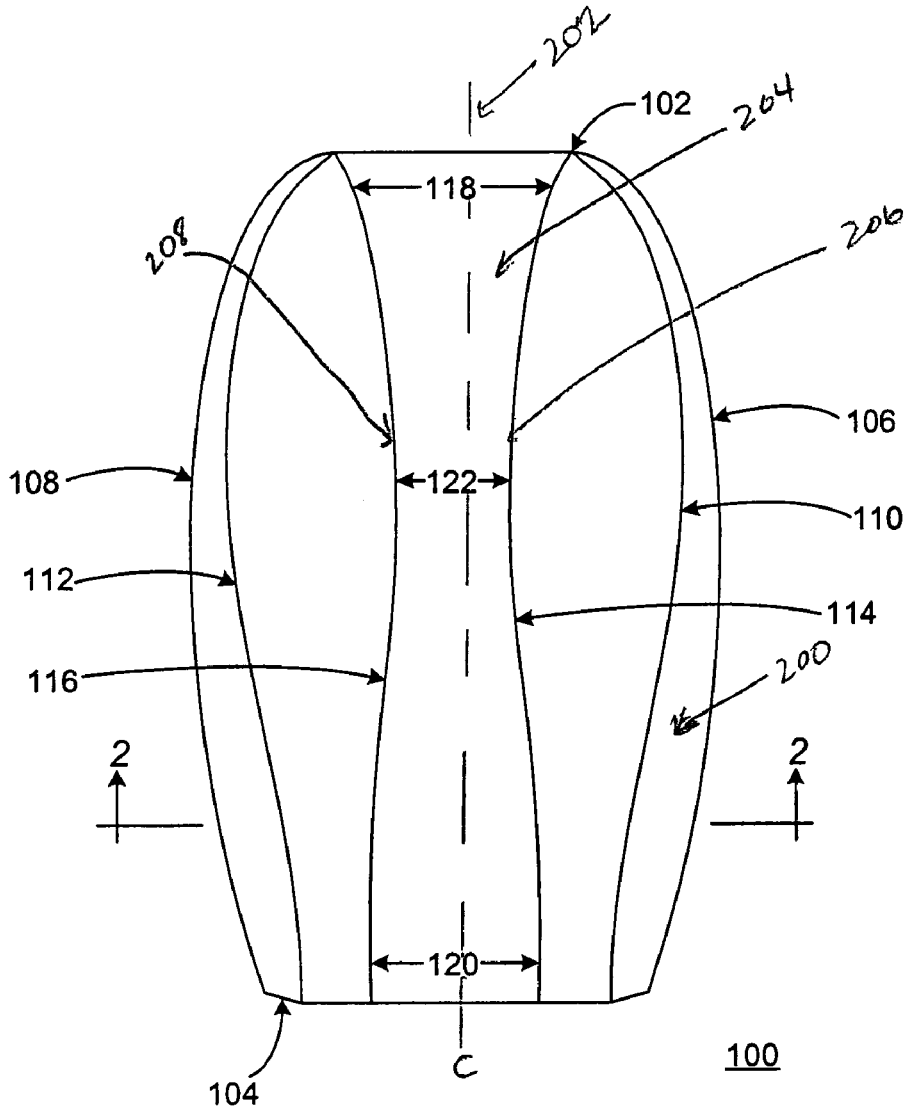
FIG. 1 is a bottom plan view of the preferred embodiment of the present invention.

Turning now to FIG. 1, there is shown a bottom plan view of a preferred embodiment of a body board 100 of the present invention. The body board 100 is generally oval in shape, with a front edge 102, and a rear edge 104 that are generally flat. A beveled area 200 runs along each side edge 106 and 108. Running down a center line 202 of the board 100 is a channel area 204. The channel area 204 is preferably in an hour-glass shape with a middle section 122 being narrower that the front section 118 and rear section 120. The channel area 204 is defined by two edges 114 and 116, which are generally convex in shape, with the apexes of the convex edges 206 and 208 lying on a line parallel to the front edge 102. Preferably, the channel edges 206 and 208 are mirror images of each other.

The beveled area 200 is bound by the outside edges 106 and 108, and bevel edges 110 and 112. Bevel edges 110 and 112, in general, follow the contour of outside edges 108 and 106.

Figure 2:
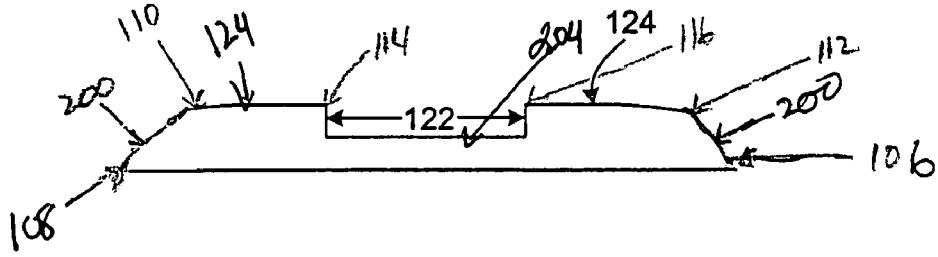
FIG. 2 is cross-sectional view taken across line 2-2 of FIG. 1.

In FIG. 2 there is shown a cross-sectional view of the body board 100 of the present invention taken across line 2-2 of FIG. 1. The channel area 204 is shown with width 122. Bottom 124 is adjacent to the channel area 204 along the outside edges 114 and 116 of the channel area. At its other edges 110 and 112 bottom 124 is adjacent to the bevel area 200 that is bound by the outside edges 106 and 108 of the board 100. In this preferred embodiment, the bevel area 200 extends only along the outside edges 106 and 108.

Figure 3:
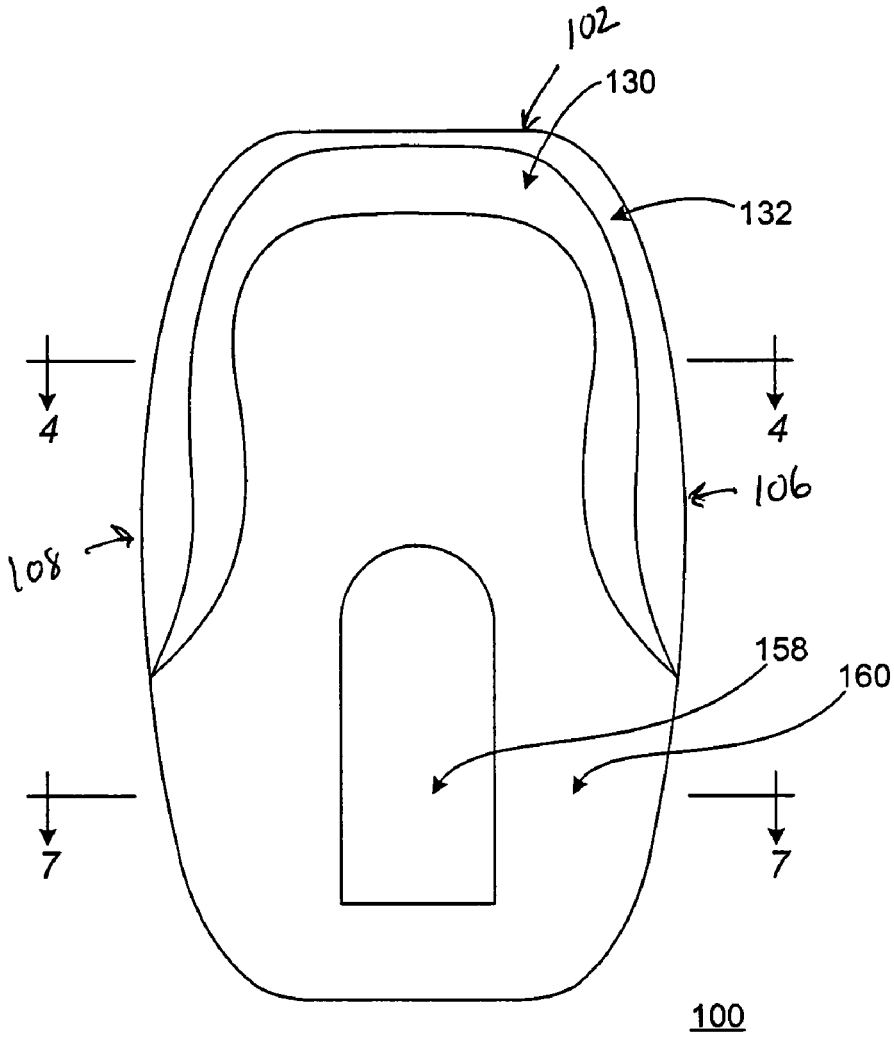
FIG. 3 is a top plan view of the preferred embodiment of the present invention.

In FIG. 3 there is shown a top plan view of the body board 100 of the present invention. Along front edge 102 and each side edge 106 and 108, there is a raised area 132. The top of raised area 132 is rounded over so that a user of board 100 may grip the board by placing their hand around raised area 132. In order to provide more gripping space, in particular, a place to put the users thumb, recessed area 130 runs adjacent to raised area 132. Located in the bottom center area of board 100 is recessed area 158. Recessed area 158 is located where a user may place their stomach, to allow for added comfort in the riding experience.

Figure 4:
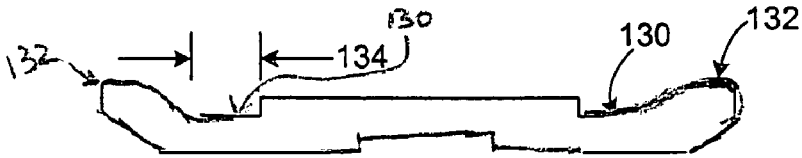
FIG. 4 is a cross-sectional view taken across line 4-4 of FIG. 3.

Turning now to FIG. 4, there is shown a cross-sectional view of the board 100 taken across line 4-4 of FIG. 3. Raised area 132 runs along the top edge of the board 100, such that a user can place their hand around the area to grasp the board 100 firmly. Preferably, raised area 132 is rounded over, and is of such a size as to be comfortable for a child as young as seven (7) or eight (8) years old to grab. Also shown is recessed area 130 which runs along raised area 132, and is provided to allow a user a larger hand-hold area. The width 134 of recessed area 130 is preferably approximately 1 to 1½ inches.

Figure 5:
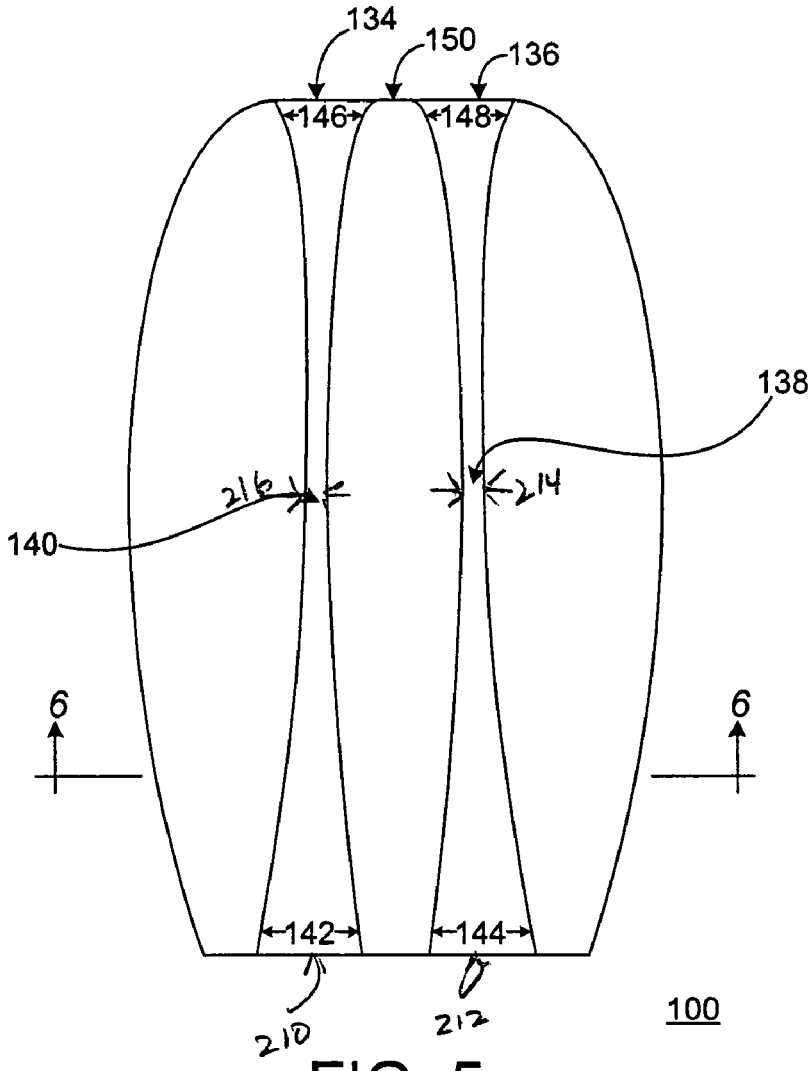
FIG. 5 is a bottom plan view of a second embodiment of the present invention.

In FIG. 5 there is shown another embodiment of the board 100. In this embodiment, there are two channel areas 138 and 140 rather than the single channel area of the preferred embodiment. Each channel area 138 and 140 is hour-glass in shape, similar to the channel area 204 of the preferred embodiment as shown in FIG. 1. As such, the widths 146 and 148 at the front ends of the channels 134 and 136 are approximately equal to the channel widths 142 and 144 at the back ends of the channels 134 and 136.

Figure 6:
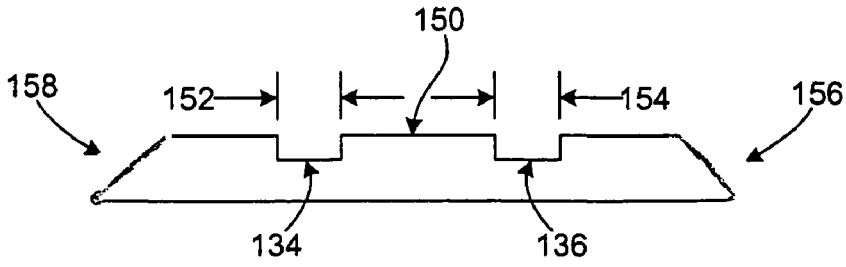
FIG. 6 is a cross-sectional view taken across line 6-6 of FIG. 5.

In FIG. 6 there is shown a cross-sectional view of the second embodiment of the board 100 taken across line 6-6 of FIG. 5. Channels 134 and 136 are shown with widths 152 and 154 that vary from front to middle to back of board 100. Also shown is beveled areas 156 and 158 which are similar to beveled area 200 of the preferred embodiment shown in FIG. 1.

Figure 7:
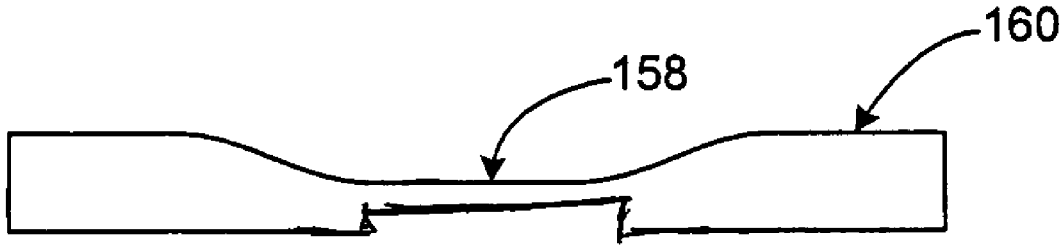
FIG. 7 is a cross-sectional view of the preferred embodiment of the present invention taken across line 7-7 of FIG. 3.

In FIG. 7 there is shown a cross-sectional view of board 100 taken across line 7-7 of FIG. 3. Shown in this view is recessed area 158, provided for the comfort of teh board user. Also shown is top are 160.

I claim:

1. A bodyboard for use on water by a user laying on the bodyboard in a prone position, comprising:

a top surface, a bottom surface, a leading edge, a trailing edge, and side edges;

the bottom surface including a pair of elevated surfaces extending from the leading edge to the trailing edge, the elevated surfaces defining a channel formed in the bottom surface extending from the leading edge to the trailing edge, the channel having a generally hourglass shape that is wider near the leading and trailing edges than near the center of the bodyboard;

the top surface having a recessed stomach cavity dimensioned to accommodate a user's stomach when the user is lying in the prone position on the top surface of the bodyboard; and a recessed area formed in the top surface of the bodyboard and extending proximal to the leading edge and at least a substantial portion of the side edges of the bodyboard, the recessed area defining a raised area along the leading and side edges of the bodyboard, the raised area providing a gripping surface for the user to grasp the bodyboard when lying on the top surface in the prone position, the recessed area extending along a sufficient portion of the side edges of the bodyboard so that the user's arm may be placed therein when the user is laying on the top surface of the bodyboard in the prone position.

2. The bodyboard as recited in claim 1, wherein the elevated surfaces are wider near the center of the bodyboard than near the leading and trailing edges.

3. The bodyboard as recited in claim 1, wherein the elevated surfaces are wider than the channel at least near the center of the bodyboard.

4. A bodyboard for use on water by a user laying on the bodyboard in a prone position, comprising:

a top, a bottom, a leading edge and a trailing edge, the bottom including a pair of elevated surfaces extending from the leading edge to the trailing edge, the elevated surfaces defining a channel formed in the bottom extending from the leading edge to the trailing edge, the channel having a generally hourglass shape that is wider near the leading and trailing edges than near the center of the bodyboard, and the top including a recessed area dimensioned to accommodate a user's stomach when the user is laying in the prone position on the top of bodyboard.

5. The bodyboard as recited in claim 4, wherein the top of the bodyboard includes a raised area on the leading edge and each side thereof to allow a user to grasp the bodyboard when the user is laying on the top of the bodyboard in a prone position.

6. The bodyboard as recited in claim 5, wherein the top of the bodyboard includes a second recessed area adjacent to the raised area in which the user's arm may be placed when the user is laying in the prone position on the top of the bodyboard.

7. The bodyboard as recited in claim 4, wherein the elevated surfaces are wider in a central area of the bodyboard than near the leading and trailing edges.

8. The bodyboard as recited in claim 7, wherein each of the elevated surfaces is wider than the channel at least in the central area of the bodyboard.

9. The bodyboard as recited in claim 4, wherein the channel includes opposing convex sidewalls extending toward each of the elevated surfaces.

10. The bodyboard as recited in claim 4, wherein the bodyboard is made from a polymeric material.

11. A bodyboard for use on water by a user laying on the bodyboard in a prone position, comprising:

a top surface, a bottom surface, a leading edge, a trailing edge, and side edges;

the bottom surface including a pair of elevated surfaces extending from the leading edge to the trailing edge, the elevated surfaces defining a channel formed in the bottom surface extending from the leading edge to the trailing edge, the channel having a generally hourglass shape that is wider near the leading and trailing edges than near the center of the bodyboard; and the top surface having a raised area to allow the user to grasp the bodyboard when lying on the top surface of the bodyboard in the prone position.

12. The bodyboard as recited in claim 11, wherein the top surface of the bodyboard includes a recessed stomach cavity dimensioned to accommodate a user's stomach when the user is lying in the prone position on the top surface of the bodyboard.

13. The bodyboard as recited in claim 11, further comprising a recessed arm channel formed in the top surface adjacent to the raised area in which the user's arm may be placed when the user is laying on the top surface of the bodyboard in the prone position.

14. The bodyboard as recited in claim 11, wherein the elevated surfaces are wider near the center of the bodyboard than near the leading and trailing edges.

15. The bodyboard as recited in claim 11, wherein the elevated surfaces are wider than the channel at least near the center of the bodyboard.

16. The bodyboard as recited in claim 11, wherein the bodyboard is made from a polymeric material.

17. A bodyboard for use on water by a user laying on the bodyboard in a prone position, comprising:

a top, a bottom, a leading edge and a trailing edge, the bottom including a pair of elevated surfaces extending from the leading edge to the trailing edge, the elevated surfaces defining a channel formed in the bottom extending from the leading edge to the trailing edge, and the top including a recessed area dimensioned to accommodate a user's stomach when the user is laying in the prone position on the top of bodyboard;

wherein the elevated surfaces are wider in a central area of the bodyboard than near the leading and trailing edges and are wider than the channel at least in the central area of the bodyboard.

* * * * *